United States Patent [19]

Homan

[11] Patent Number: 4,645,073

[45] Date of Patent: Feb. 24, 1987

[54] ANTI-CONTAMINATION HAZARDOUS MATERIAL PACKAGE

[75] Inventor: Gerlof Homan, Olivette, Mo.

[73] Assignee: Survival Technology, Inc.

[21] Appl. No.: 719,130

[22] Filed: Apr. 2, 1985

[51] Int. Cl.[4] ..... A61J 5/00; B65D 25/02

[52] U.S. Cl. ..... 206/219; 215/6; 215/10; 215/DIG. 8; 604/88; 604/414; 604/416

[58] Field of Search ..... 128/DIG. 24; 206/216, 206/219, 438, 222; 215/6, 10, DIG. 8; 604/408, 410, 415, 416, 88, 92, 414

[56] References Cited

U.S. PATENT DOCUMENTS

| | | | |
|---|---|---|---|
| 2,371,774 | 3/1945 | Nosik | 215/6 |
| 2,494,456 | 1/1950 | Still . | |
| 3,066,671 | 12/1962 | Cohen | 604/416 |
| 3,397,694 | 8/1968 | Ogle | 215/DIG. 8 |
| 3,654,926 | 4/1972 | Rietman . | |
| 4,211,588 | 7/1980 | Raines . | |
| 4,381,776 | 5/1983 | Latham, Jr. . | |

FOREIGN PATENT DOCUMENTS

| | | | |
|---|---|---|---|
| 0214575 | 4/1961 | Austria | 215/6 |
| 2091229 | 7/1982 | United Kingdom | 215/6 |

*Primary Examiner*—William Price

*Assistant Examiner*—Jimmy G. Foster

*Attorney, Agent, or Firm*—Cushman, Darby & Cushman

[57] ABSTRACT

A package for enabling a user to mix a diluent with a hazardous material and then fill a syringe with the solution in such a way as to substantially prevent the hazardous material from entering the immediate atmospheric environment comprising a vial and a sealed bag enclosing the entire vial so as to provide exterior sealed containment for the vial in the event of unexpected failure of the vial container and elastomeric stopper assembly to sealingly contain the hazardous material. The vial is sealed within the bag so as to form a space exteriorly of the vial which is controlled by the bag and which is operable to receive any hazardous material in the form of aerosol or droplets that may pass outwardly through the elastomeric stopper assembly as a result of the withdrawal of the syringe needle therefrom and the increased interior gas pressure created within the vial container by the injection of diluent therein. The controlled space has a volume sufficient to enable the pressure therein to remain near atmospheric pressure in the event of the escape of gas pressure from the vial container as aforesaid so that there is substantially no tendency for gas therein to cause hazardous material which may have passed into the controlled space to escape to the atmosphere when the needle is removed from the access septum assembly of the bag.

19 Claims, 2 Drawing Figures

ANTI-CONTAMINATION HAZARDOUS MATERIAL PACKAGE

Figure 1:
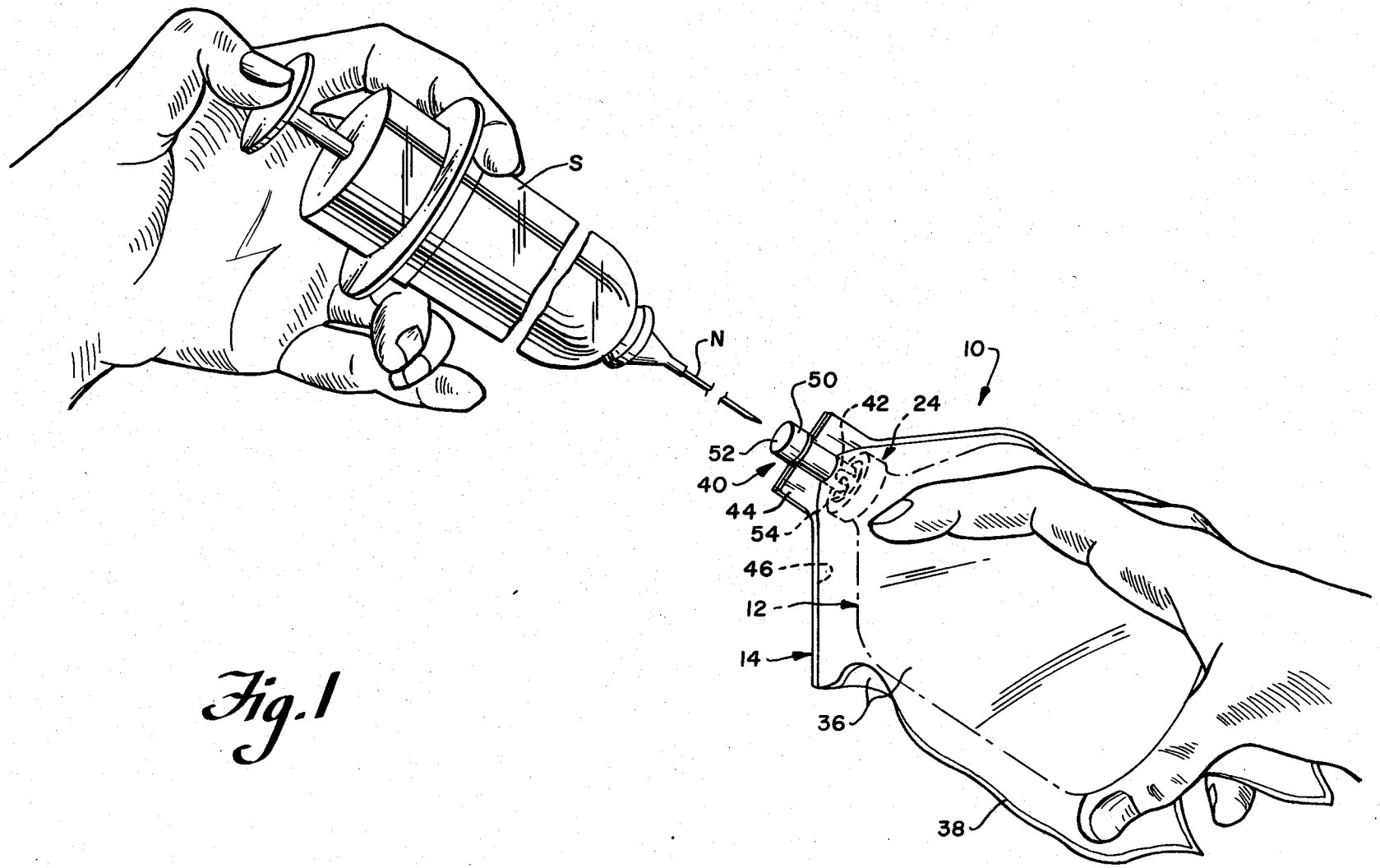

This invention relates to the packaging of hazardous materials and more particularly to the packaging of such materials which enable a user to mix a diluent with the hazardous material and then fill a syringe with the solution in such a way as to substantially prevent the hazardous material from entering the immediate atmospheric environment.

While the present invention is applicable to hazardous materials in general the specific example of hazardous materials to which the invention is particularly applicable are freeze dried cytotoxic drugs such as are used extensively in chemotherapy treatment of cancer patients.

Freeze dried cytotoxic drugs are usually contained within a vial of the type which includes an open ended glass container and an elastomeric stopper assembly disposed in sealing relation within the open end of the container so as to enable the freeze dried cytotoxic drug to be sealingly contained therein. The elastomeric stopper assembly is adapted to receive therethrough a needle of a diluent containing syringe. The amount of freeze dried cytotoxic drug within the container is an amount such that when dissolved in a proper amount of diluent within the container the solution has a volume substantially less than the volume of the sealed interior of the container. Nevertheless, when the diluent is injected into the container through the needle by the operation of the diluent containing syringe there is sufficient volume of solution within the container to displace the gas therein into a smaller volume and hence to increase its pressure. It is generally well known that this increase in pressure may cause an aerosol effect when the needle is removed. This aerosol effect may result in the passage outwardly through the elastomeric stopper assembly of portions of the cytotoxic drug in the form of aerosol or droplets. This aerosoling action presents a highly dangerous situation to the nurse or other personnel diluting the cytotoxic material with a diluent. The usual practice is to effect withdrawal of the syringe needle soon after the diluent has been injected since the increase in air pressure is also acting on the end of the plunger of the syringe.

Presently there are two procedures available for enabling the user to protect against the aerosol effect placing the cytotoxic drugs in the immediate atmospheric environment. One method or apparatus which is used is the so-called glove box where the user inserts his hands into gloves which can manipulate the diluent containing syringe and the vial within an enclosed space. This procedure is bothersome and somewhat cumbersome to perform.

A second procedure or apparatus which may be utilized is to provide a dispensing pin of the type, for example, disclosed in U.S. Pat. No. 4,211,588. The dispensing pin.includes a spike arranged to be pierced through the elastomeric stopper. The spike has two openings extending therethrough one for receiving the needle of the diluent containing syringe and the other connected to an exterior filter. The opening for receiving the needle is provided with a septum through which the needle may be passed. Once the spike is pierced through the elastomeric stopper of the vial, the dispensing pin serves to maintain the gas pressure within the vial container at atmospheric pressure during the injection of the diluent therein. By the same token, the air pressure within the vial container is also maintained at atmospheric pressure when the patient injecting syringe is subsequently filled with the cytotoxic drug solution within the vial container. By maintaining the pressure within the vial container at substantially atmospheric pressure, the tendency for the hazardous material within the vial container to aerosol as the needle is withdrawn from the septum is materially reduced if not entirely eliminated. A difficulty with the use of a dispensing pin is that the device is relatively expensive and there is no guarantee that the filter will always be effective to prevent the passage of cytotoxic drugs therethrough, particularly if the filter is wet when the diluent is introduced into the vial container causing outward flow of gas and entrained material into the filter.

It is an object of the present invention to provide a package of the type described which will be not only effective to prevent the hazardous material or cytotoxic drug from entering the immediate atmospheric environment when diluent is injected into the vial container thereof but to provide, in addition, protection against unexpected failure of the vial container and elastomeric stopper assembly to sealingly contain the hazardous material or cytotoxic drug.

In accordance with the principles of the present invention this objective is obtained by providing a package which includes a vial of the type described and a sealed bag enclosing the entire vial so as to provide exterior sealed containment for the vial in the event of unexpected failure of the container and elastomeric stopper assembly to sealingly contain the hazardous material. The bag is formed of plastic sheet material and has a septum assembly therein operable to sealingly receive a needle therethrough and to provide a seal in response to the needle being withdrawn therefrom. The vial is sealed within the bag so as to form a space exteriorly of the vial which is controlled by the bag and into which access can be obtained by extending a needle of a syringe through the septum assembly. The plastic sheet material of the bag is sufficiently transparent as to enable a user to move a needle of a diluent containing syringe through (1) the septum assembly, (2) an extent of the controlled space and (3) the elastomeric stopper assembly of the vial so that the syringe may be thereafter operated to inject the diluent into the container thus creating an increase in gas pressure within the container. The controlled space is operable to receive any hazardous material in the form of aerosol or droplets that may pass outwardly through the elastomeric stopper assembly as a result of the withdrawal of the syringe needle therefrom and the increased interior gas pressure created within the container as aforesaid. The controlled space has a volume sufficient to enable the pressure therein to remain near atmospheric pressure in the event of the escape of gas pressure from the vial container so that there is substantially no tendency for gas therein to cause hazardous material which may have passed into the controlled space to escape to the atmosphere when the needle is removed from the septum assembly.

Another object of the present invention is the provision of a package of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

Figure 2:
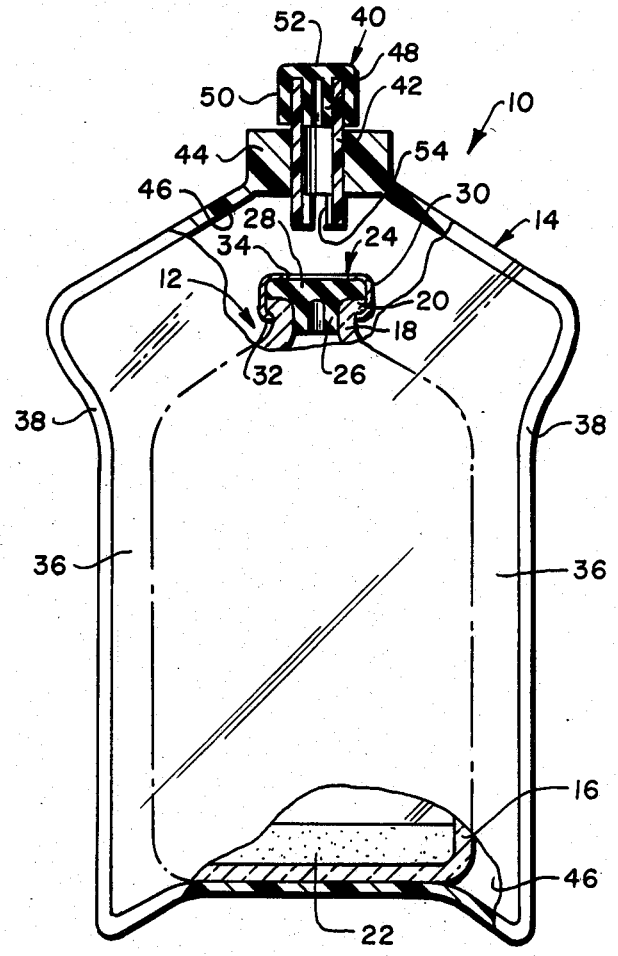

In the drawings:

FIG. 1 is a perspective view of a package embodying the principles of the present invention showing the same in a position to be used with a diluent containing syringe; and FIG. 2 is a front elevational view of the package shown in FIG. 1 with certain parts broken away for purposes of clearer illustration.

Referring now more particularly to the drawings, there is shown therein a package, generally indicated at 10, which embodies the principles of the present invention. The package 10 includes a vial, generally indicated at 12, and a bag, generally indicated at 14, enclosing the entire vial so as to provide exterior sealed containment for the vial.

The vial 12 includes a glass container 16 having an open end 18 which terminates in a radially outwardly extending annular flange 20. Disposed within the container 16 is a hazardous material 22, such as freeze dried cytotoxic drugs of the type which are well known in the chemotherapy treatment of cancer patients. Mounted within the open end 18 of the container 16 in sealed relation therewith is a elastomeric stopper assembly, generally indicated at 24. The stopper assembly 24 includes an elastomeric stopper member which includes a cylindrical portion 26 disposed within the open end 18 of the container 16 and a diskshaped upper portion 28 which extends radially outwardly over the annular flange 20 of the container 16. A thin metal member 30 of generally inverted cup-shaped configuraton is extended peripherally over the upper portion 28 of the stopper and the annular flange 20. The lower periphery of the metal member 30 is swaged beneath the flange 20, as indicated at 32. The metal member 30 has an aperture 34 formed in the central portion thereof which overlies the stopper member upper portion 28 so as to permit penetration of a needle through the central portion of the stopper member. The stopper member is made of a suitable elastomeric material, as, for example, rubber or the like.

The bag 14 is preferably formed of plastic sheet material which may be either in the form of a sleeve, or as shown, in the form of two elastic sheets 36 which are peripherally heat sealed, as indicated at 38. The plastic sheets 36 may be made of any appropriate plastic material. A preferred material is high tear strength polyethylene having at lease a thickness of approximately 0.005 inches. The plastic sheets 36 are preferably entirely transparent although an opague sheet provided with a properly positioned transparent viewing window may be utilized, if desired.

The bag 14 includes a septum assembly, generally indicated at 40. As shown, the septum assembly 40 includes an access tube 42 which is fixedly secured through upper flat portions 44 formed from the the plastic sheets 36. The flat portions 44 are fusingly sealed to the exterior periphery of the access tube 42, between the ends thereof so that an upper end portion extends exteriorly above the bag and an interior end portion extends into a space 46 which is positioned exteriorly of the vial and is controlled by the bag 14 and into which access can be obtained by extending a needle of a syringe through the septum assembly 40.

The controlled space 46 has a volume which is at least as great as the volume of diluent to be injected into the vial container 12 to form the cytotoxic drug solution. Preferably, the volume is greater than the aforesaid minimum so as to ensure that any escape of pressure build up within the vial container 16 into the space 46 will not raise the pressure within the space 46 appreciably above atmospheric pressure.

The septum assembly 40 also includes a septum member which is made of any suitable elastomeric material, such as rubber, includes an inner cylindrical portion 48 of a size to snugly fit within the interior of the upper end portion of the access tube 42. The septum member also includes an integral outer cylindrical portion 50 which is capable of being inverted with respect to the inner tubular portion 42 and a disk portion 52 which integrally joins the two cylindrical portions 48 and 50 at a position along the upper end of the inner cylindrical portion 48 and an adjacent end of the invertable outer cylindrical portion 50. As shown, the mounting of the septum member on the upper end portion of the access tube 42 is completed by inverting the outer cylindrical portion 50 over the exterior surface of the upper end portion of the access tube. It can be seen that the septum member in its operative position, as shown in FIG. 2, provides a seal for the space 46 and the central wall portion 52 thereof provides a means through which access to the space by a syringe needle or the like can be obtained.

It is important when effecting the diluent injecting operation that the diluent containing syringe needle be inserted first through the septum assembly 40 and then through an extent of the space 46 and finally through the elastomeric stopper assembly 24 into the interior of the vial container 16. It is within the contemplation of the present invention to provide a fixed connection between the access tube 42 and the elastomeric stopper assembly 24 which will maintain an aligned relationship between the septum assembly 40 and the elastomeric stopper assembly 24 while at the same time providing for the aforesaid communication of the space 46 therebetween. However, it is preferable to enclose the vial 12 loosely within the bag 14 so as to enable the user to manually effect movement of the vial within the space 46 into a position wherein the elastomeric stopper assembly 24 is aligned with the septum assembly 40 so as to receive the needle therethrough. In order to insure the aforesaid communication of the space 46 between the elastomeric stopper assembly 24 and septum assembly 40 there is formed in the lower end portion of the access tube 42 which extends within the space 46 a pair of diametrically opposed slots 54. The lower end of the access tube 42 can thus be used as a guide to position the elastomeric stopper assembly 24 in alignment with the septum assembly 40 with the slots 54 providing ample communication with the space 46 therebetween.

FIG. 1 illustrates the use of the package 10 when it is desired to form a solution from the freeze dried cytotoxic drug material 22 sealingly contained within the vial container 60 by the elastomeric stopper assembly 24. As shown, the formation of the solution requires the utilization of a conventional diluent containing syringe indicated at S in FIG. 1. The syringe S includes the usual syringe needle, indicated at N in the drawings, through which the diluent passes when the syringe is operated. FIG. 1 illustrates that the operator has grasped the package 10 in one hand and has manually manipulated the loosely contained vial 12 within the bag 14 into a position wherein the elastomeric stopper assembly 24 is positioned in engagement with the inner end of the access tube 42 of the septum assembly 40. As previously indicated when the vial is so positioned, the needle piercing wall portion 52 of the septum assembly 40 is axially aligned with the needle piercing wall portion 28 of the elastomeric stopper assembly 24.

As shown in FIG. 1, the user holding the package 10 in the aforesaid position in one hand, grasps the syringe S in the other and effects a piercing insertion of the needle N through (1) the septum wall portion 52, (2) an extent of the intervening controlled space 46 and (3) the wall portion 28 of the elastomeric stopper assembly 24. When the sharpened end of the needle N has communicated with the interior of the container 16, the user then operates the syringe S to cause the diluent contained therein to flow outwardly thereof through the needle N and into the interior of the container 16. As the diluent is injected into the interior of the vial container 16, the gas therein is reduced in volume. The engagement of the elastomeric material of the wall portion 28 of the stopper assembly 24 seals with the exterior of the needle and retains this increased pressure within the container.

The diluent is mixed with the cytotoxic drug material 22 so as to form a solution and the user then either before the diluent and cytotoxic material is fully mixed, or immediately thereafter, withdraws the syringe needle N. As the needle N is withdrawn any tendency for the internal pressure which has been created within the container 16 to cause cytotoxic material in the form of aerosol or droplets to pass outward through the pierced wall portion 28 will simply result in such material passing into the controlled space 46 where the increased pressure escaping from the interior of the container 60 is immediately dissipated. Consequently there is substantially no elevated pressure existing within the space 46 which would tend to cause any cytotoxic material which has been received within the space 46 as a result of withdrawal of the needle from the stopper assembly 24 under the internal pressure conditions of the container 16 to pass outwardly through the pierced wall portion 52 of the septum when the needle N is withdrawn therefrom.

An advantage of the present invention is that while the space 46 is sufficiently large enough to relieve all the interior pressure created within the vial container 16 during the makeup of the solution, where the elastomeric stopper assembly 24 does effectively prevent a substantial decrease in the internal pressure after needle withdrawal, this pressure will be available to facilitate the filling of the patient injecting syringe when such injection is required. In this regard it will be noted that the container 12 is aligned and positioned in the manner previously described and as shown in FIG. 1 preparatory to receiving the needle of the patient injecting syringe. Once the needle has been pierced through the elastomeric stopper assembly 24 so as to communicate with the interior of the vial container 16, the entire package 10 may be inverted to accomplish the filling operation.

It can thus be seen that the package 10 not only enables a user to mix a diluent with the hazardous material in the vial in such a way as to substantially prevent the hazardous material from entering the immediate atmospheric environment but it also facilitates the subsequent filling of the syringe with the solution. Moreover, the bag 14 which entirely encompasses and seals the vial provides exterior sealed containment for the vial in the event of unexpected failure of the container and elastomeric stopper assembly to sealingly contain the hazardous material up to the point of actual usage. For example, the toughness of the plastic material which forms the bag 14 would provide exterior sealed containment for the vial even under circumstances where the vial was sufficiently impacted to perhaps crack or break the same so as to free the cytotoxic material 22. Under such circumstances the hazardous material would be exposed only to the controlled space 46.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit of the following claims.

What is claimed is:

1. A package for enabling a user to mix a diluent with a hazardous material and then fill a syringe with the solution in such a way as to substantially prevent the hazardous material from entering the immediate atmospheric environment comprising a vial including an open ended glass container, a hazardous material in said container, and an elastomeric stopper assembly disposed in sealing relation with the open end of said container for enabling the hazardous material to be sealingly contained therein, and a sealed bag enclosing the entire vial so as to provide exterior sealed containment for the vial in the event of unexpected failure of the container and elastomeric stopper assembly to sealingly contain said hazardous material, said hazardous material being in a form suitable to be readily dissolved by a diluent injected from a diluent containing syringe into said container through a needle extended through said elastomeric stopper assembly, said hazardous material being in an amount such that when dissolved in a proper amount of diluent within said container the solution has a volume substantially less than the sealed interior volume of said container, said bag being formed of plastic sheet material and having septum means therein operable to sealingly receive a needle therethrough and to provide a seal in response to the needle being withdrawn therefrom, said vial being sealed within said bag so as to form a space exteriorly of the vial which is controlled by the bag and into which access can be obtained by extending a needle of a syringe through said septum means, the plastic sheet material of said bag being sufficiently transparent as to enable a user to move a needle of a diluent containing syringe through (1) said septum means (2) an extent of said controlled space and (3) said elastomeric stopper assembly so that the syringe may be thereafter operated to inject the diluent into the container thus creating an increase in gas pressure within said container, said controlled space being operable to receive any hazardous material in the form of aerosol or droplets that may pass outwardly through said elastomeric stopper assembly as a result of the withdrawal of the syringe needle therefrom and the increased interior gas pressure created within said container as aforesaid, the controlled space being initially devoid of any hazardous material or diluent therefor and having a volume sufficient to enable the pressure therein to remain near atmospheric pressure in the event of the escape of gas pressure from said vial container as aforesaid so that there is substantially no tendency for gas therein to cause hazardous material which may have passed into said controlled space to escape to the atmosphere when the needle is removed from said septum means.

2. The package as defined in claim 1 wherein said vial is enclosed within said bag in a manner free from fixed connections therebetween.

3. The package as defined in claim 2 wherein said vial is loosely enclosed within said bag and the plastic sheet material of said bag is sufficiently flexible as to enable a user to manually move said vial within said bag into an optimum position to enable the user to move the needle as aforesaid.

4. The package as defined in claim 3 wherein said elastomeric stopper assembly includes an elastomeric stopper member including a cylindrical portion engaged within the open end of said container, said container having an annular flange extending outwardly from said open end, said stopper member including a disk shaped portion integral with said cylindrical portion extending over said annular flange and a centrally apertured thin metal member extending over an outer marginal extent of said disk shaped portion and beneath the annular flange of said container.

5. The package as defined in claim 4 wherein said septum means includes a septum member formed of elastomeric material, and an access tube fixedly sealed within the plastic sheet material of said bag, said access tube having an exterior end portion disposed exteriorly of said bag and an interior end portion disposed in communication with said controlled spaced, said septum member including an inner cylindrical portion disposed with the interior of the exterior end portion of said access tube, an invertable outer cylindrical portion inverted over the exterior of the exterior end portion of said access tube and a disk-shaped portion between said inner and outer cylindrical portions covering the outer end of said inner cylindrical portion so as to receive the needle therethrough.

6. The package as defined in claim 5 wherein said plastic sheet material is entirely transparent and has a thickness of at least approximately 0.005 inches.

7. The package as defined in claim 6 wherein said plastic material is high tear strength polyethylene.

8. The package as defined in claim 7 wherein said hazardous material comprises a freeze dried cytotoxic drug.

9. The package as defined in claim 1 wherein said elastomeric stopper assembly includes an elastomeric stopper member including a cylindrical portion engaged within the open end of said container, said container having an annular flange extending outwardly from said open end, said stopper member including a disk shaped portion integral with said cylindrical portion extending over said annular flange and a centrally apertured thin metal member extending over an outer marginal extent of said disk shaped portion and beneath the annular flange of said container.

10. The package as defined in claim 9 wherein said septum means includes a septum member formed of elastomeric material, and an access tube fixedly sealed within the plastic sheet material of said bag, said access tube having an exterior end portion disposed exteriorly of said bag and an interior end portion disposed in communication with said controlled spaced, said septum member including an inner cylindrical portion disposed with the interior of the exterior end portion of said access tube, an invertable outer cylindrical portion inverted over the exterior of the exterior end portion of said access tube and a disk-shaped portion between said inner and outer cylindrical portions covering the outer end of said inner cylindrical portion so as to receive the needle therethrough.

11. The package as defined in claim 10 wherein said plastic sheet material is entirely transparent and has a thickness of at least approximately 0.005 inches.

12. The package as defined in claim 11 wherein said plastic material is high tear strength polyethylene.

13. The package as defined in claim 12 wherein said hazardous material comprises a freeze dried cytotoxic drug.

14. The package as defined in claim 1 wherein said plastic material is high tear strength polyethylene.

15. The package as defined in claim 1 wherein said plastic sheet material is entirely transparent and has a thickness of at least approximately 0.005 inches.

16. The package as defined in claim 15 wherein said plastic material is high tear strength polyethylene.

17. The package as defined in claim 16 wherein said hazardous material comprises a freeze dried cytotoxic drug.

18. The package as defined in claim 1 wherein said plastic material is high tear strength polyethylene.

19. The package as defined in claim 1 wherein said hazardous material comprises a freeze dried cytotoxic drug.

* * * * *